US006233938B1

(12) United States Patent
Nicodemus

(10) Patent No.: US 6,233,938 B1
(45) **Date of Patent: *May 22, 2001**

(54) RANKINE CYCLE AND WORKING FLUID THEREFOR

(75) Inventor: Mark Nicodemus, LeRoy, NY (US)

(73) Assignee: Helios Energy Technologies, Inc., LeRoy, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/536,494

(22) Filed: Mar. 27, 2000

Related U.S. Application Data

(63) Continuation-in-part of application No. 09/115,347, filed on Jul. 14, 1998, now Pat. No. 6,041,604.

(51) Int. Cl.[7] ..... F01K 25/08
(52) U.S. Cl. ..... 60/651; 60/657; 60/671
(58) Field of Search ..... 60/651, 671, 657

(56) References Cited

U.S. PATENT DOCUMENTS 4,424,677 * 1/1984 Likasavage ..... 60/671
4,558,228 * 12/1985 Larjola ..... 60/657
4,961,311 * 10/1990 Pave et al. ..... 60/657
5,490,386 * 2/1996 Keller et al. ..... 60/657
5,603,218 * 2/1997 Hooper ..... 60/671 X
6,041,604 * 3/2000 Nicodemus ..... 60/671

OTHER PUBLICATIONS

Foster–Pegg, "Steam Bottoming Plants for Combined Cycles", pp. 203–211, Apr. 1978.*
El–Wakil, "Powerplant technology", pp. 31–35, 342–350, 1984.*
El–Sayed et al, "A Theoretical Comparison of the Rankine and Kalina cycles", pp. 97–102, Nov. 1985.*
V. Ganapathy, "Waste Heat Boiler Deskbook", pp. 205–213, 1991.*
Mainord et al, "Thermal Decomposition Studies on Methylene Chloride from 450 to 850 F", pp. 1–6, Sep. 1999.*

* cited by examiner

*Primary Examiner*—Hoang Nguyen
(74) *Attorney, Agent, or Firm*—Robert J. Bird

(57) ABSTRACT

Thermal decomposition studies have been performed on methylene chloride at temperatures of 450, 480, 550, 650, 750, and 850° F. After the 550, 650, 750, and 850° F. studies, samples were taken and analyzed for acidic decomposition products of methylene chloride. Qualatative analyses were also done using a gas chromatograph. This report presents the results of the studies. A description of the apparatus and procedures used to obtain the measured data is also included in the report.

11 Claims, 6 Drawing Sheets

RANKINE CYCLE AND WORKING FLUID THEREFOR

CROSS-REFERENCE TO RELATED APPLICATION(S)

This is a continuation-in-part of my applicaton Ser. No. 09/115,347 filed Jul. 14, 1998, now U.S. Pat. No. 6,041,604.

BACKGROUND OF THE INVENTION

This invention relates to thermodynamic cycles, and more particularly to a working fluid for use in a Rankine cycle. The Rankine cycle is the standard thermodynamic cycle in general use for electric power generation. The essential elements of a Rankine cycle system are: 1) a boiler to change liquid to vapor at high pressure; 2) a turbine to expand the vapor to derive mechanical energy; 3) a condenser to change low pressure exhaust vapor from the turbine to low pressure liquid; and 4) a pump to move condensate liquid back to the boiler at high pressure.

Water (steam) is the standard Rankine cycle working fluid. Water has many practical advantages. It is abundantly available, it is non-toxic, and generally non-corrosive. However, the thermodynamic properties of water are not the most ideal. A working fluid with more suitable thermodynamic properties, to increase the efficiency of a Rankine cycle, is desired and is an object of this invention.

Various other working fluids have been tried, but water remains the standard.

Prior art that I know of is as follows:

U.S. Pat. No. 4,896,509 to Tamura et al discloses a vapor cycle working fluid of 1,2-dichloro-1,1,2-trifluorethane.

U.S. Pat. No. 4,876,855 discloses vapor cycle working fluids including heptane, perfluorohexane, 1—1 dimethyl cyclohexane, and undecane.

U.S. Pat. No. 4,557,851 to Enjo et al discloses a vapor cycle working fluid of mixtures of trichlorofluoromethane and one of the group: difluoroethane, isobutane, and octafluorocyclobutane.

U.S. Pat. No. 4,530,773 to Enjo et al discloses a vapor cycle working fluid of a mixture of dichlorotetrafluoroethane and difluoroethane.

U.S. Pat. No. 4,465,610 to Enjo et al discloses vapor cycle working fluids of mixtures of pentafluoropropanol and water.

U.S. Pat. No. 4,224,795 discloses a vapor cycle working fluid of monochlorotetrafluoroethane.

U.S. Pat. No. 4,008,573 to Petrillo discloses a vapor cycle working fluid of trifluoroethanol.

U.S. Pat. No. 3,802,185 to Tulloch discloses a vapor cycle working fluid of 1,2,4-trichlorobenzene.

U.S. Pat. No. 3,753,345 discloses a vapor cycle working fluid of a mixture of hexafluorobenzene an perfluorotoluene.

U.S. Pat. No. 3,702,534 to Bechtold discloses a vapor cycle working fluid of perhalogenated benzenes of the formula $C_6 Br_x Cl_y F_z$.

The following prior art is filed herewith, and is incorporated by reference in this specification as background material:

1. Steam Bottoming Cycles for Combined Plants (April 1978) by R. W. Foster-Pegg
2. Powerplant Technology by M. M El-Wakil pages 30–35; 342–345; 348–350
3. A Theoretical Comparison Of The Rankine And Kalina Cycles (November 1985) by El-Sayed and Tribus.

4. Waste Heat Boiler Deskbook by V. Ganapathy pages 205–213
5. Thermal Decomposition Studies On Methylene Chloride From 450 to 850° F., a report on research commissioned by me, together with a letter of transmittal thereof from Kellogg Brown & Root to me (Dec. 22, 1998). this report relates to thermophysical properties of methylene chloride.

SUMMARY OF THE INVENTION

According to this invention, A Rankine cycle thermodynamic system for converting thermal energy of a working fluid to mechanical energy in a cycle of evaporation, expansion, condensation, and compression, includes methylene chloride as the working fluid.

A system for performing the cycle of this invention includes a heat recovery boiler, an engine, a condenser, an open deaerating heater to receive condensate from the condenser, a boiler feed pump to receive working fluid from the deaerator and return it to the boiler, and a recuperative feed heater between engine and condenser to receive vapor from the engine and working fluid from the boiler feed pump en route to the boiler. The temperature differential between working fluid and heat source is at its minimum where working fluid enters the economizer section of the boiler and the waste heat medium leaves the economizer. The mass flow rate ratio of working fluid to waste heat medium is in the range from 0.5 to >1.

DRAWINGS

DETAILED DESCRIPTION

Figure 1:
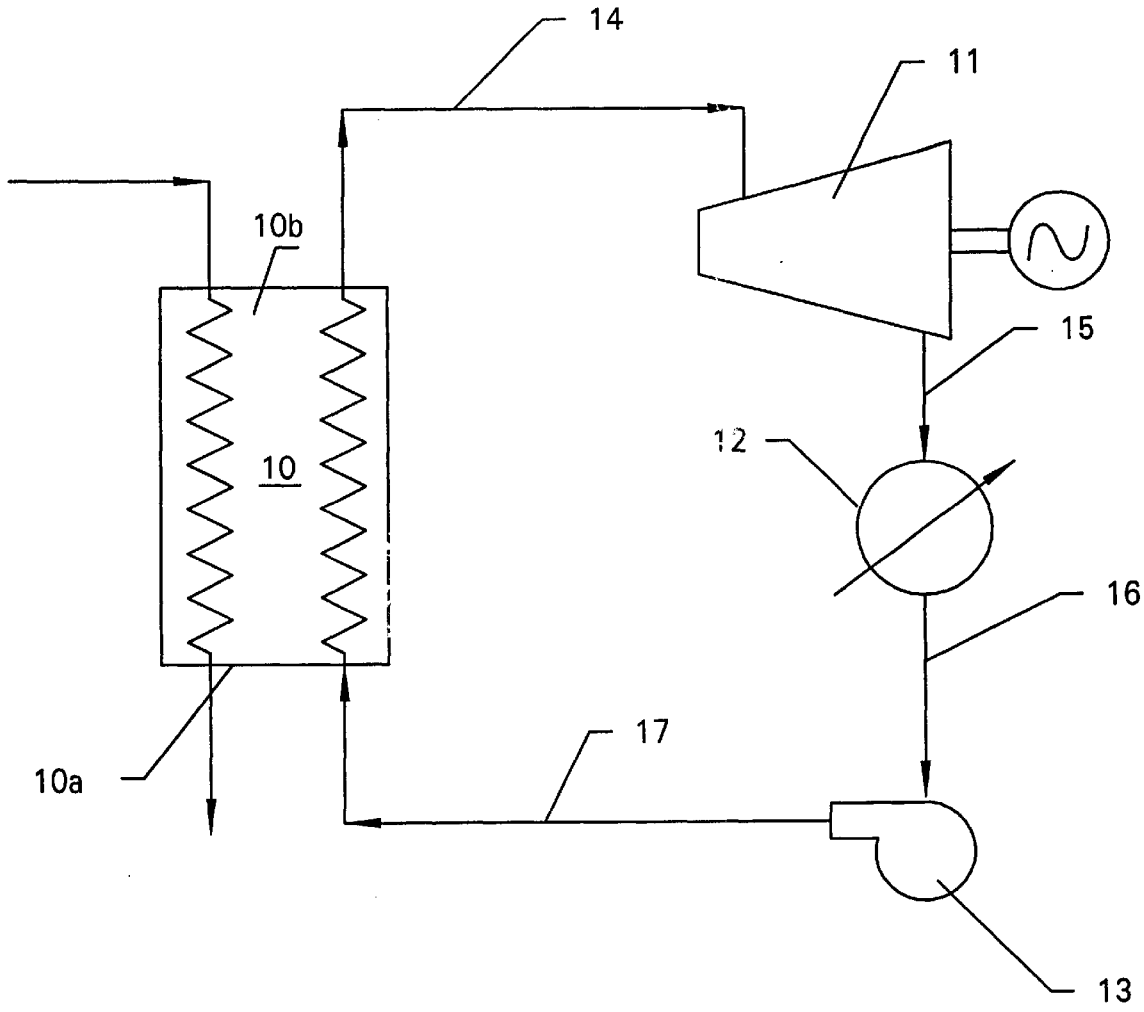
FIG. 1 is a flow diagram of a basic Rankine vapor cycle.

FIG. 1 represents a system for performing a Rankine cycle. It includes a boiler 10, a turbine 11, a vapor condenser 12, and a condensate or boiler feed pump 13, all connected in series by appropriate piping 14, 15, 16, 17. The boiler 10 includes an economizer section **10*a* at its feed inlet side, an evaporator section, and a superheater section 10*b*** at is vapor outlet side.

A working fluid is evaporated at high pressure in the boiler 10. The high pressure vapor is then expanded in the turbine 11 to produce mechanical work. Exhaust vapor from the turbine, now at low pressure, is condensed to liquid in the condenser 12. Low pressure condensate from the condenser 12 is pumped back to the boiler 10 at high pressure by the boiler feed pump 13. Heat is supplied to the boiler from a heat source such as combustion, nuclear reaction, or other known source. Heat of condensation is removed from the condenser to a cold reservoir such as a body of water.

Factors in the choice of any alternative working fluid include: Safety (non-flammability, low toxicity); Environmental Compatibility; Availability (cost production capability); Non-Corrosiveness (compatibility with commonly used materials); Physical Properties (specific heats of liquid and vapor, heat of vaporization, normal boiling point, molecular weight, entropy, enthalpy, density of liquid and vapor, freezing point, vapor pressure, critical point, thermal stability).

I have examined the properties of methylene chloride. Methylene chloride (or dichloromethane) has heretofore been used primarily as a refrigerant or as a solvent, paint remover, or thinner. I have found it a desirable working fluid for the Rankine cycle. Methylene chloride satisfies virtually all of the above requirements. It has the potential to provide a more thermally efficient cycle than most organic fluids, binary mixture systems, or water, and its unique set of physical properties should permit the use of smaller less expensive system components without penalty.

I have also proven that methylene chloride is very stable at high temperatures and pressures, making it especially suitable for the combined cycle and direct fired systems. There has been a consensus in the industry that organics as alternative Rankine cycle working fluids are inherently unstable and therefore their utility is limited to low temperature power cycles such as geothermal, solar or other novel and limited applications, e.g. U.S. Pat. No. 4,424,677.

I have commissioned extensive and elaborate research, experimentation, and testing, and have now documented the excellent thermal stability of methylene chloride, a halogenated hydrocarbon. Information of this nature has apparently never been available as the literature is silent with regard to these operating ranges. My research is the first which verifies the feasibility of methylene chloride for use in otherwise conventional combined cycle systems, and I am the first to unequivocally set forth its compatibility and usefulness for this application.

A combined cycle is a combination of cycles operating at different temperatures, each of which cycles is otherwise independent of the other. The cycle operating at the higher temperature is called a topping cycle. The topping cycle rejects heat at high enough temperature to drive the bottoming cycle. The rejected heat is recovered in a waste heat recovery boiler to provide vapor for the bottoming cycle. A typical combined cycle system includes a gas turbine as its heat source. The exhaust gas provides a portion of its available energy to the Rankine cycle. The efficiency of the combined cycle system is greater that of the gas turbine cycle alone.

The maximum energy available from the exhaust gas is the mechanical energy that could be taken form the gas when it is cooled to the ambient temperature. This theoretical maximum is expressed as:

$$\text{Available Energy} = Cp\ (T - To) - ToCp\ 1n\ (T/To)$$

where:

Cp is specific heat of exhaust gas at constant pressure;

T is exhaust gas temperature; and

To is ambient or sink temperature (dead state)

The above equation represents 100% of work obtainable (or available energy) from the exhaust gas.

Second law efficiency of the bottoming cycle is the ratio of actual work output to available energy, or:

$$\text{Second law eff.} = \text{Work output}/\text{Available energy}$$

As an example for analysis, consider a system in which turbine exhaust is at 1000° F., gas flow rate is 100,000 lb/hr, and that cooling sink is at 55° F. If the stream of hot gas of 0.25 Btu/ lb/° F. constant thermal capacity is taken to flow without friction, and is cooled to sink temperature at constant composition, it is found that the maximum mechanical power that can be taken from the stream is 2.99 megawatts (102 Btu/lb of gas). This amount is 100% of the availability of the exhaust gas. It has been reported in the literature that, under these same boundary conditions, the maximum efficiency presently achievable in the Rankine bottoming cycle, in which water is the bottoming cycle working fluid, is 58.2%. That means that 58.2% of available energy in the turbine exhaust gas is the maximum amount recoverable as work. This determination is made by "second law" analysis, described in this and the preceding paragraph.

I have devised a system which, operating under identical parameters, provides a second law efficiency of 73.3%, a gain of 26%. In an ideal, 100% efficient turbine, the same cycle would have a second law efficiency of greater than 85%. While not achievable, this theoretical maximum underscores the potential for this fluid, when implemented into my unique configuration.

The base case cycle referred to is a very simple single pressure steam cycle with no preheating or regenerative feedwater heating, i.e. the boiler operates at one pressure which means the working fluid has a fixed, single evaporation temperature, and said working fluid enters the boiler's economizer section at essentially the ambient temperature (allowing for a reasonable terminal difference at the condenser).

While the goal of any bottoming cycle is maximum thermal efficiency, practical issues demand that certain concessions be made due to economic and other technological constraints. For example, while the most efficient systems would seek to cool the exhaust gas as much as possible, dew point considerations (acid corrosion) and plume buoyancy requirements demand that stack gas remain typically at 200° F. or higher. Some unique and specialized plant configurations may go somewhat lower, say 150° F. minimum, but they are the exception. Any attempt to cool stack gas to the ambient (in an effort to extract 100% of the available heat) is neither practical nor, upon close examination, even possible in conjunction with a steam expansion (Rankine) power cycle. To explain, it is theoretically possible, strictly from a heat transfer standpoint, to cool a hot gas stream from any high temperature to the ambient, or dead state temperature-if an infinite heat exchange surface area could be utilized. Of course economic realities preclude this, but for the sake of analysis it is a profitable exercise to examine such a theoretical case. As before, let us suppose that the dead state temperature is 55° F., e.g. both atmospheric air and cooling water. This is the lowest available heat sink temperature. Therefore, available energy calculations relative to the gas turbine exhaust heat source are determined on this basis. Furthermore, in our combined cycle, the vapor turbine exhaust pressure (corresponding to the dead state saturation temperature, 55F) is calculated utilizing these values.

Figure 5:
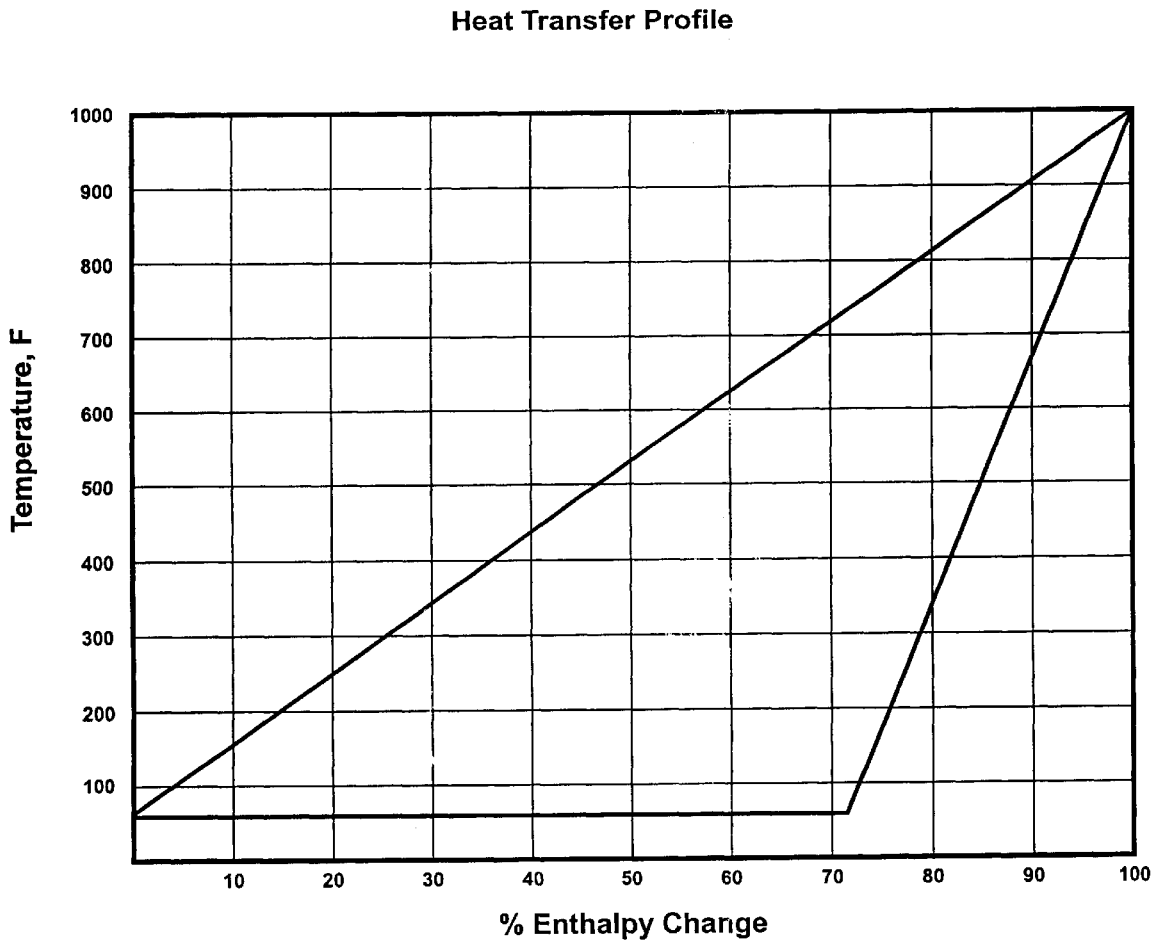
FIG. 5 is a temperature profile for cooling a hot gas stream to ambient temperatures.
Figure 6:
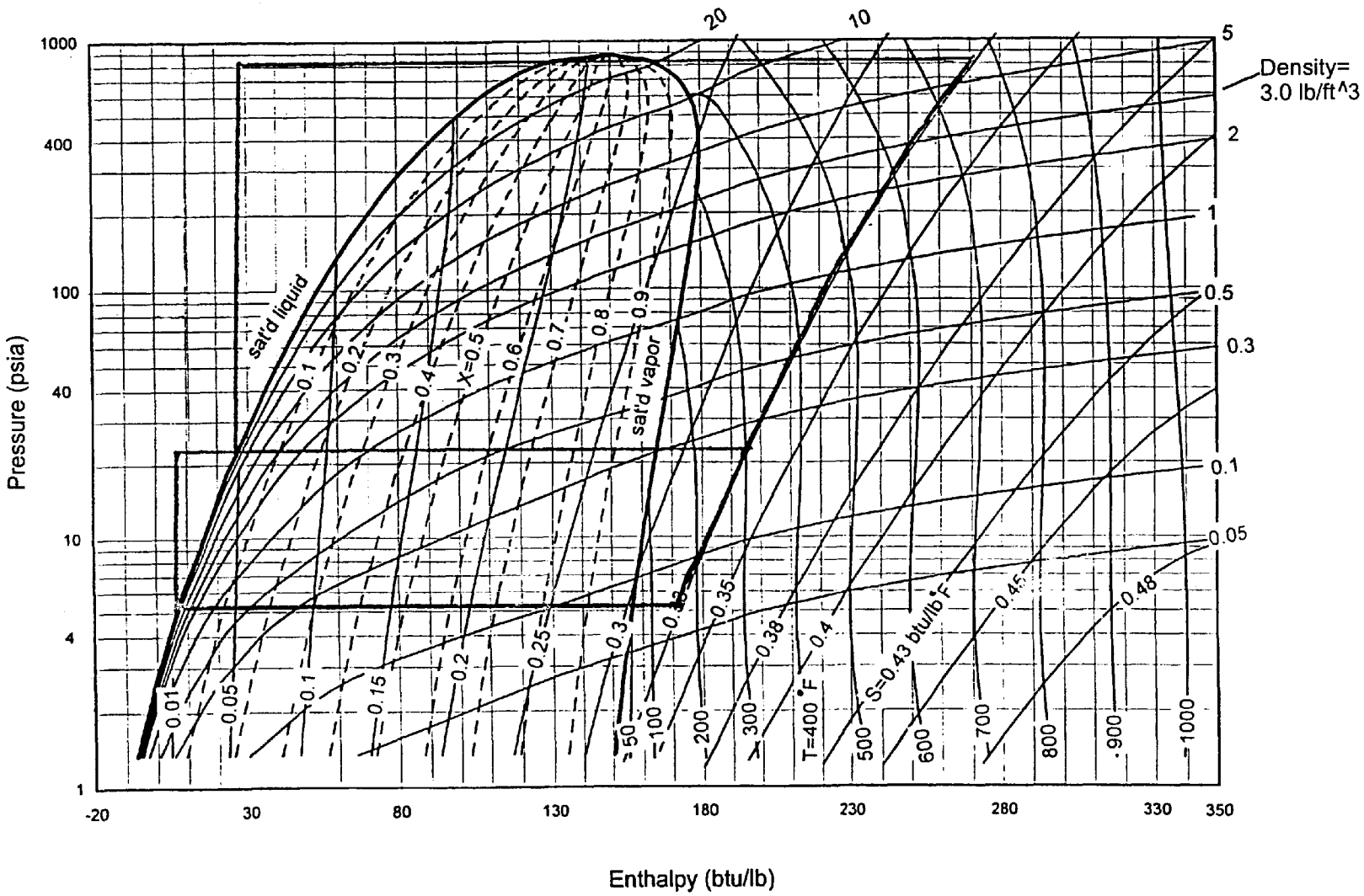
FIG. 6 is a Pressure-Enthalpy diagram for methylene chloride, according to FIG. 2.

Examination of a heat transfer diagram, FIG. 5, wherein all available heat (in a theoretical infinite heat exchanger) is transferred to the water, quickly reveals that the 'pinch point' occurs at the dead state temperature (55° F.) and therefore at the corresponding saturation pressure, namely 0.214 psia for water. The "pinch point" of a temperature-enthalpy heat transfer profile is where the heat source and working fluid are at their closest approach and where, normally, the onset of working fluid vaporization (boiling) occurs.

The pinch point is of paramount importance. FIG. 5 illustrates that in order to extract 100% of the available energy from a hot gas by bringing it to the dead state temperature, and having a working fluid also at that base temperature as the coolant, requires an infinite heat exchange surface and vaporization at the working fluids corresponding saturation pressure. While this is theoretically possible from a heat transfer standpoint, it has absolutely no value in a Rankine power cycle which implicitly requires expansion from a higher, pressure to, ideally, the lower dead state temperature/pressure condition. Thus, for production of work, it is inescapable that evaporation take place at some higher pressure. The pinch point, by necessity, is raised. It cannot be at the dead state and therefore the concept of infinite heat surface area for complete heat acquisition, though theoretically possible, is irrelevant for turboexpander applications. Raising the pinch point forces a loss of availability, but enables a functional liquid/vapor power cycle (Rankine cycle) which continues to be mankind's most effective method for converting heat to work.

Figure 4:
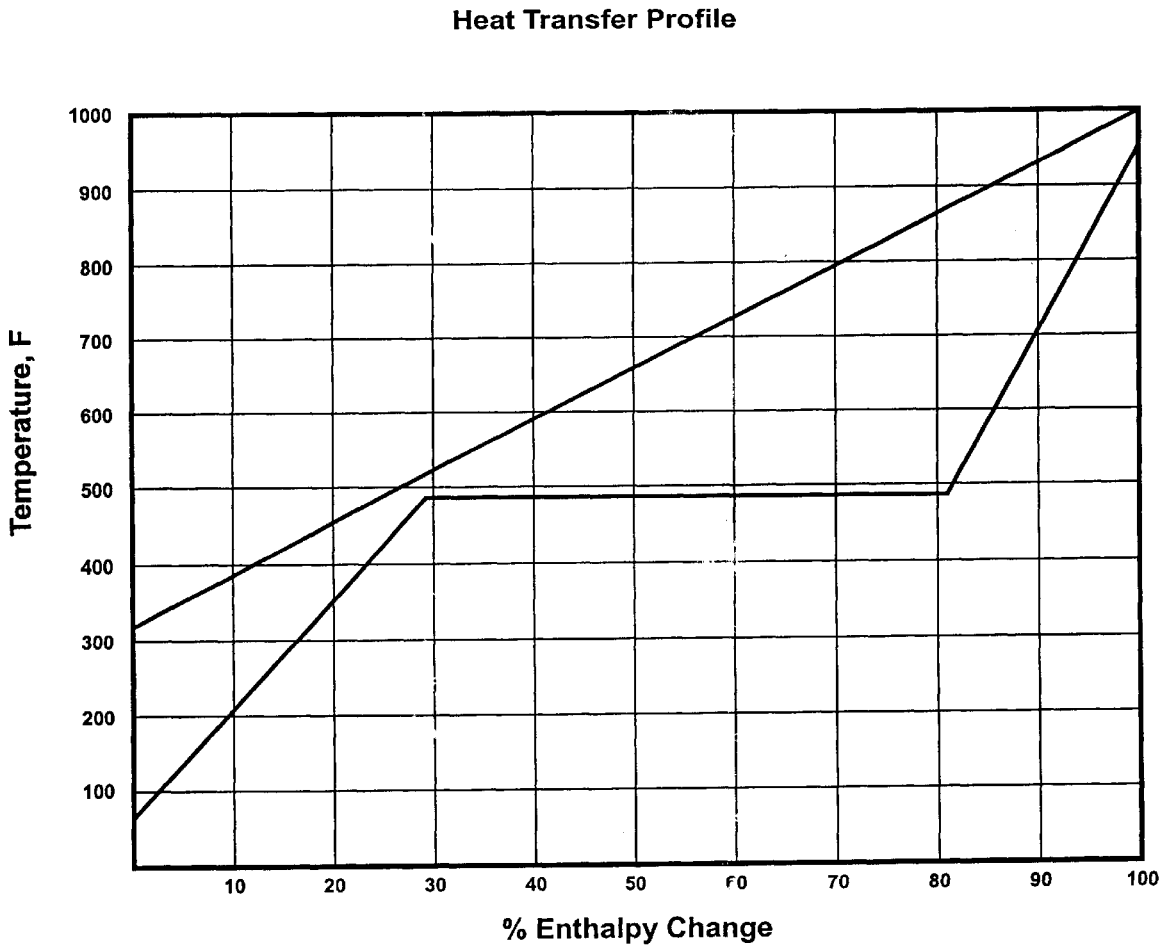
FIG. 4 is a comparable temperature profile of a water/steam system.

Seeing then that bringing the hot gas to the ambient dead state temperature is not tantamount to creating the most efficient Rankine cycle, the task then becomes finding the optimized pressure for evaporation of the water, i.e. where to locate the pinch point. In our previously cited example from the literature, under the boundary conditions stipulated, it has been determined that 600 psia is the optimum evaporation pressure to gain the most second law efficient, single-pressure steam bottoming cycle, i.e. 58.2%. FIG. 4 depicts the pinch point and resultant heat transfer profile of water and hot gas moving countercurrently through the heat recovery boiler of the referenced cycle, including realistic temperature approaches at the pinch point and superheated vapor exit.

Regarding these approach points, it has also been suggested that the theoretical addition of unlimited heat transfer surface in these regions, to reduce the approach points to zero, will create an ideal heat transfer profile. This is not the case. While some improvement can be gained, albeit theoretical, the heat capacity characteristics of the two inherently different fluids have built in inequalities that will not enable all of the available energy to be captured. Finite temperature differences will remain as heat is transferred from a higher to a lower level causing irreversibilities that must be accepted. As FIG. 4 reveals, the exhaust gas exits the economizer to the stack a full 230° F. hotter than the incoming working fluid, a significant loss of availability. Zero approaches will cause only marginal improvements.

Two methods have come to the forefront as a means to improve on the heat transfer profile and therefore efficiency of the bottoming cycle. First, it has become common practice in the industry to design bottoming steam cycles with multiple pressure boilers, usually two or three. This design creates multiple pinch points at different levels and the result is more heat being extracted from the hot, gas turbine exhaust. Another method, though not widely used in bottoming cycle technology, is the supercritical system. Supercritical water (or other fluids) do not undergo a phase change and therefore avoid the familiar plateau which is prevalent on standard sub-critical heat transfer profiles. In both of these technologies, heat transfer to the water occurs across smaller temperature differences, i.e. the space between the curves is decreased, entropy generation is less and efficiency increases. Unfortunately, these systems are much more complex and capital intensive than a basic, single pressure, sub-critical steam cycle.

A third concept has been proposed which incorporates a multi-component working fluid, e.g. ammonia/water. Such cycles create a varying boiling point in the boiler, allowing heat transfer to occur across a broader range. The goal is the same- capturing more available energy from the flue gas.

I have carefully analyzed the bottoming cycle to determine what improvements were needed which would enable a warmed (by deareation) working fluid to still extract enough heat to bring the hot gas down to the desired, minimum stack temperature, while operating with a single pressure boiler. Furthermore, the cycle must have simplicity comparable to a single pressure steam cycle and the second law efficiency was to be at least 20% better under identical boundary conditions.

My discovery was this; an alternative fluid was needed and the internal boiler configuration must be optimized so as to be conducive to maximizing the heat acquisition capabilities of the fluid. Methylene chloride is my fluid of choice because it not only meets necessary safety and environmental requirements, but its unique physical properties render it nearly ideal, thermodynamically, as a Rankine Cycle working fluid.

Heretofore, very little reliable information has been available regarding the thermal properties of this fluid at high pressures. I addressed this obstacle by commissioning the development of the most extensive, accurate and reliable computer program available for predicting the fluid's properties and behavior. The accuracy of the program has been substantiated by the experimental data which I generated during a separate high pressure and temperature thermal stability testing program.

I have, through this in-depth research and analysis, acquired the only valid information which can be utilized to accurately construct a boiler which will contribute to such an improvement in combined cycle technology. The boiler must have an economizer section which will, in essence, have a "pinch point" at the location where the working fluid first enters the boiler economizer and the hot gas exits to the stack. Previous boiler designs have, by necessity, their heat transfer surfaces constructed so that the pinch point occurs at or near the flue gas exit from the evaporator section. This is necessary due to the temperature of the hot gas when it first enters the boiler. The initial temperature of the exhaust gas does have a bearing on where the pinch point might occur and, in a steam cycle, it would only be possible to move it to the location I specify if the gas were greater than about 1800F initially. This is never the case in modem combined cycle systems where the gas entering the boiler is seldom higher than 1150F, and often less than 1000F. Thus, the slope of the upper curve (as in FIG. 3) has a fairly fixed range and controls pinch point location options.

It has been standard practice in the industry and engineering profession to define the pinch point as that location on the heat transfer profile where, 1) the working fluid and heat source fluid are at their closest approach, and 2) that same point being where the working fluid begins to boil (vaporize). My innovation necessitates the refining of that definition. In my heat recovery boiler design, the pinch point can be more narrowly defmed simply as, that location where the twofluids are at their closest approach, which is, uniquely, where they first cross paths in the economizer, and not at the vaporizer. The working fluid is still subcooled and usually several hundred degrees below its saturation point.

While it is possible for any other system to employ a boiler designed to merely mimic this one key feature (by indiscriminately manipulating flow rates and feedwater temperatures), it is not, nor would it ever be done, as it would drastically reduce the performance and efficiency of any conventional system. In fact, it would generally render any other system inoperative. Only my bottoming cycle system can beneficially incorporate this unique boiler design.

It's important to note that the following other key and novel elements must be simultaneously employed for an optimized, efficient system. My inventive grouping of key elements therefore consists of the following list of innovations:

a) Strategic boiler design with the previously mentioned pinch point location, said boiler being of the single pressure configuration.
b) The mass flow ratio of working fluid to hot gas heating medium of 0.5 to >1. (conventional systems never exceed 0.20)
c) Said system's working fluid never reaches its critical point and said boiler operates at a working fluid pressure of at least 650 psia.
d) Within the limits of stated temperature, flow and pressure constraints, said working fluid remains capable, due to its peculiar thermal properties, of cooling a hot, gas turbine exhaust stream from a level greater than 1000° F. down to less than 200° F., flowing countercurrently through said heat recovery boiler.
e) Said working fluid, upon exiting said boiler, is entirely a superheated vapor, capable of providing significant shaft work via expansion through a heat engine (vapor turbine). Such superheated condition is not dependent upon supplemental or auxiliary firing.
f) The heat source (gas turbine exhaust from the topping cycle) enters the heat recovery boiler at no hotter than 1250F.

I have determined that there is no known Rankine Cycle configuration which can meet all of these criteria, except my novel system design. With respect to working fluids, water, ammonia, and ammonia/water solutions are precluded primarily because of the high specific heats of the liquid(s). At the mass flow ratios I stipulate, either superheated vapor states are impossible or the heat source cannot be below 200F upon exiting the boiler. Organics, such as the various fluorocarbons have critical points which are too low. I have observed that hydrocarbons above their critical point behave in an erratic and unstable manner. Moreover, fluids above their critical point prohibit the use of standard drum type boiler designs. Supercritical fluids require once-through boilers which introduce their own set of complexities with respect to heat transfer, two-phase flow, and the like. No other known fluid can operate in the bottoming cycle I've designed except methylene chloride. Only this system can achieve second law efficiencies over 20% higher than a comparable single pressure, steam bottoming cycle, under identical boundary conditions.

Figure 2:
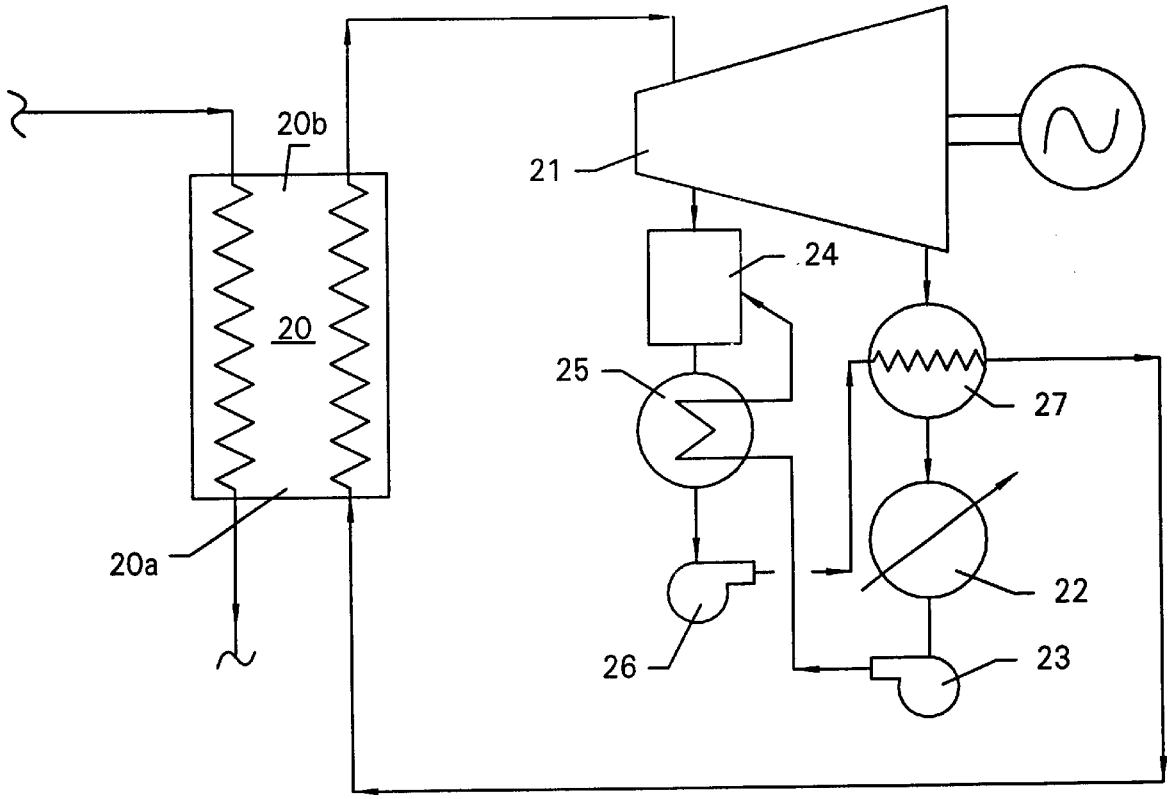
FIG. 2 is a diagram of the vapor or bottoming side of a combined gas and vapor cycle according to this invention.

FIG. 2 represents the bottoming cycle of a combined gas and Rankine cycle system, according to this invention. It includes a waste heat recovery boiler 20, a turbine 21, a vapor condenser 22, and a condensate pump 23, all connected in series by appropriate piping. The boiler 20 includes an economizer section 20*a* at its feed inlet side, an evaporator section, and a superheater section 20*b* at is vapor outlet side. The primary path of working fluid is from boiler 20 to turbine 21, to condenser 22, and ultimately back to the boiler.

Condensate from the condenser 22 moves from the condensate pump 23 into a deaerating heater 24. A portion of working fluid vapor may also be extracted from an intermediate stage of the turbine 21 into the deaerating heater 24 to combine there with condensate. The condensate and extracted vapor, if any (now liquid), flows from the deaerating and into a boiler feed pump 26.

Exhaust gas from a gas turbine topping cycle is the heat source for the waste heat recovery boiler 20.

The working fluid in the bottoming cycle of FIG. 2 is methylene chloride. In a conventional steam cycle, or combined cycle, steam expands to a vacuum pressure and a temperature of say, 90° F. By comparison, methylene chloride expands to a vacuum pressure, but at a temperature which is still relatively high, say 320° F. In other words, although methylene chloride in this state is fully expanded and has given up its mechanical energy, it is still hot and a significant amount of heat is wasted if that spent vapor were to be condensed directly as it leaves the turbine. Between the turbine and condenser, there is recoverable sensible heat remaining in the methylene chloride.

The hot methylene chloride exhaust from the turbine provides a source of recoverable heat to preheat the boiler feed from the pump 26. Accordingly, boiler feed from the pump 26, on its way to the boiler 20, first passes through a recuperative feed heater 27 between turbine 21 and condenser 22 to recover heat from the otherwise spent vapor.

Figure 3:
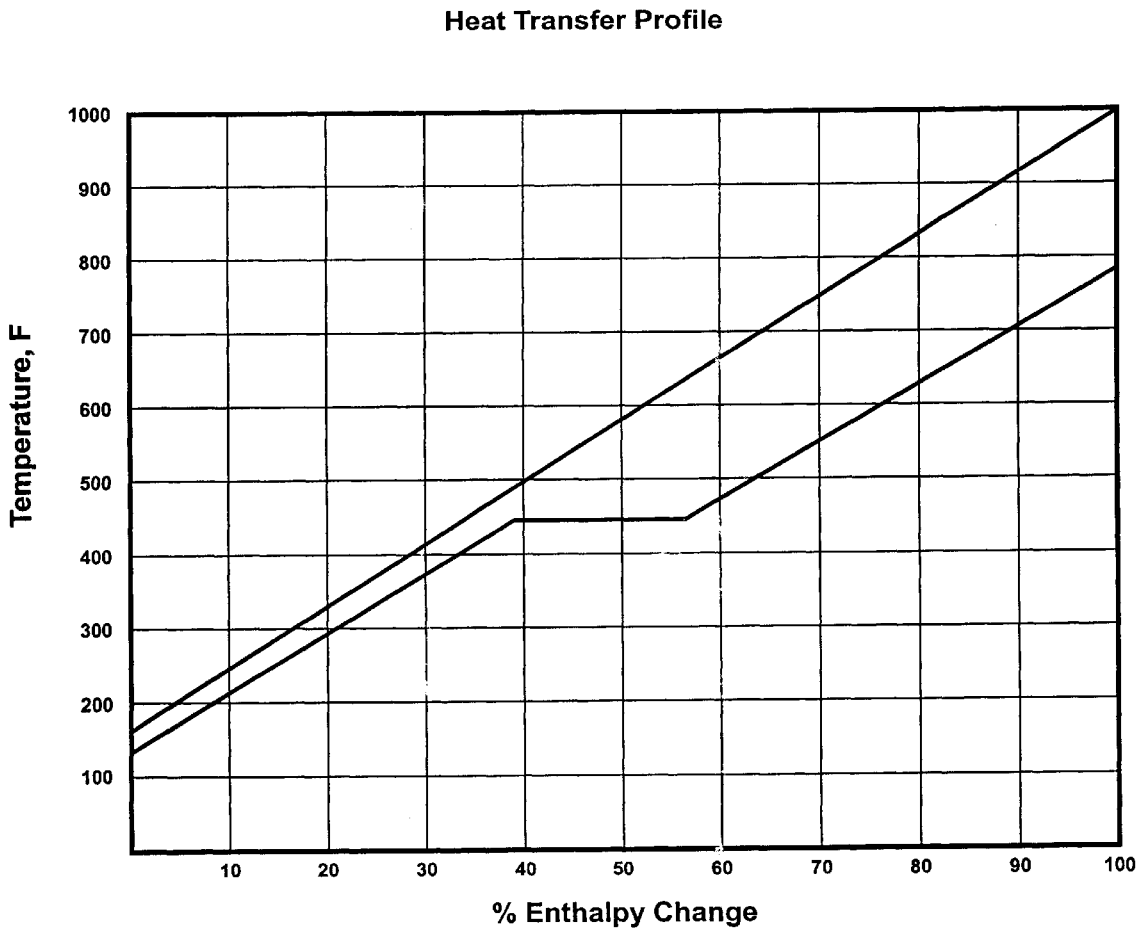
FIG. 3 is a temperature profile relating to the system of FIG. 2.

FIG. 3 is an example of a temperature profile relating to the bottoming cycle of FIG. 2. The upper curve (right to left) represents the decreasing temperature of exhaust gas or waste heat as it moves through the waste heat recovery boiler. The lower curve (left to right) represents the increasing temperature of working fluid as it moves through the waste heat recovery boiler. Waste heat enters the boiler (superheater end) at about 1000° F., and leaves the boiler (economizer end) at about 159° F. Working fluid enters the boiler as liquid at about 134° F., and leaves the boiler as vapor at about 750° F.

As seen in FIG. 3, the ascending temperature profile of the working fluid follows very closely the descending temperature profile of the waste heat. Indeed, the slopes of the two curves are nearly parallel for both liquid and superheated vapor phases of the working fluid. Note also the relatively short horizontal (vaporizing) portion of the curve. This close match of the two profiles is most striking in the lower left, showing a very close coordination of waste heat given up and received as sensible heat in the working fluid. This lower left portion of the curves represents the economizer section of the boiler, which is normally the most inefficient area of heat transfer, i.e. greatest degree of entropy generation. The area or space between upper and lower curves represents lost work. This area for a methylene chloride system (FIG. 3) is smaller that of comparable curves (FIG. 4) representing a conventional water/steam system. This translates directly to greater efficiency in this system in which methylene chloride is the working fluid.

In a typical bottoming cycle of a conventional combined gas and steam cycle system, the mass flow rate ratio of working fluid to gas in the heat recovery boiler is typically in the range of 0.12 to 0.15. In other words, every pound of gas through the boiler generates only about 0.12 pound to 0.15 pounds of steam. In the system of this invention, the mass flow rate ratio is in a range from 0.5 to more than 1.0. In other words, every pound of gas through the boiler generates from 0.5 pounds to more than one pound of vapor.

Methylene chloride can be used as the working fluid in: 1) the bottoming cycle in combined cycle systems, single or multi-pressure; 2) direct fired fossil fuel system; 3) geothermal or other low temperature cycles; 4) any system where cooling towers are used, where cooling water to the condenser may be warmer that a typical cold reservoir.

It must be understood that in some situation it may be desirable to add stabilizers to methylene chloride under certain operating conditions, such as under high temperatures (compounds such as nitroalkane, alkylene oxide, and others have proven to offer benefits to methylene chloride in some of its other uses). Nevertheless, the working fluid I propose is materially and substantially methylene chloride, with or without stabilizers or additives.

The foregoing description of a preferred embodiment of this invention, including any dimensions, angles, or proportions, is intended as illustrative. The concept and scope of the invention are limited only by the following claims and equivalents.

What is claimed is:

1. A combined cycle thermodynamic system for transferring heat from the exhaust gas of a gas turbine topping cycle to a working fluid, and converting said heat to mechanical energy in a bottoming Rankine cycle, said system including, in a closed cycle forming a working fluid path:

a boiler with economizer, vaporizer, and superheater sections to transfer heat from said exhaust gas to said working fluid;

means to convey said exhaust gas at a mass flow rate EG in a first direction through said superheater, vaporizer, and economizer sections of said boiler;

means to convey said working fluid at a mass flow rate WF along said working fluid path, in a second direction counter to said first direction, through said economizer, vaporizer, and superheater sections of said boiler to thereby heat, vaporize, and superheat said working fluid in said respective sections;

a heat engine to expand said vaporized and superheated working fluid to thereby convert thermal energy thereof to mechanical energy;

a condenser to condense said working fluid;

a condensate pump to recirculate said condensed working fluid back to said boiler;

a recuperative feed heater disposed between said engine and said condenser to receive working fluid exhaust vapor from said engine, and to receive liquid working fluid from said boiler feed pump en route to said boiler;

the ratio of mass flow rate WF of said working fluid to mass flow rate EG of said exhaust gas being in the range from 0.50 to >1;

the temperature differential between said exhaust gas and said working fluid being at its minimum where said working fluid enters said economizer section and said exhaust gas leaves said economizer section;

said working fluid having unique thermophysical properties such that upon leaving said boiler it is theoretically capable, in an ideal, constant entropy expansion process, of yielding a total isentropic enthalpy drop of at least 70% of the available energy of said exhaust gas as determined by second-law analysis.

2. A thermodynamic system as defined in claim 1, wherein said working fluid is esentially methylene chloride.

3. A Rankine cycle system for transferring thermal energy from a fluid heat medium to a working fluid and converting said thermal energy to mechanical energy, said system including a boiler, a turbine, a condenser, and a boiler feedpump, all operatively connected to form a series flowpath for said working fluid;

said boiler being a single-pressure heat recovery boiler with economizer, vaporizer, and superheater sections to transfer thermal energy from said fluid heat medium to said working fluid;

said fluid heat medium moving at a mass flow rate FHM in a first direction through said superheater, vaporizer and economizer sections of said boiler, said fluid heat medium entering said superheater section at a temperature not greater than 1250° F.;

said working fluid moving at a mass flow rate WF in a second direction, counter to said first direction, through said economizer, vaporizer, and superheater sections of said boiler to thereby heat, vaporize, and superheat said working fluid in said respective sections, said working fluid being in a sub-critical state through said boiler, and at a pressure not less than 650 psia in said boiler;

the ratio of mass flow rates of said working fluid WF to said fluid heat medium FHM being in the range from 0.50 to >1;

said boiler and the internal heat transfer surfaces thereof being so configured that the temperature differential between said fluid heat medium and said working fluid is at its minimum where said working fluid enters said economizer section and said fluid heat medium leaves said economizer section;

said working fluid capable of extracting heat from said fluid heat medium to cool said fluid heat medium from above 1000° F. to below 200° F.

4. A Rankine cycle system as defined in claim 1, wherein said working fluid is esentially methylene chloride.

5. A Rankine cycle system for transferring heat from a heat source to a working fluid, and producing shaft work by expansion of said working fluid in a heat engine, said working fluid being admitted to said engine at an inlet pressure between 650 psia and 900 psia, at an inlet temperature below 850° F., and in a sub-critical state;

said working fluid having thermophysical properties such that, in a hypothetical ideal, frictionless, and adiabatic expansion through said engine, said fluid exhausting to pressure corresponding to saturation at dead state temperature is theoretically capable of total isentropic enthalpy drop of at least 70% of the available energy of said heat source as determined by second law analysis;

said system including a recuperative feedheater operatively connected to said engine to recover heat from said working fluid exhausted from said engine.

6. A Rankine cycle system as defined in claim 5, wherein said working fluid is esentially methylene chloride.

7. A method of producing shaft work in a heat engine operating in a Rankine cycle, including the following steps:

transferring heat from a fluid heat source to a working fluid to vaporize and superheat said working fluid;

admitting said working fluid to said engine at an inlet pressure between 650 psia and 900 psia, at an inlet temperature below 850° F., and in a sub-critical state;

expanding said working fluid in said engine to convert thermal energy of said working fluid to mechanical energy; and exhausting said expanded working fluid from said engine to a recuperative feedheater to recover thermal energy from said exhausted working fluid;

said working fluid having thermophysical properties such that, in a hypothetical ideal, frictionless, and adiabatic expansion through said engine, said fluid exhausting to pressure corresponding to saturation at dead state temperature is theoretically capable of total isentropic enthalpy drop of at least 70% of the available energy of said heat source as determined by second law analysis.

8. A method as defined in claim 7, wherein said working fluid is esentially methylene chloride.

9. A process for tansferring heat from the exhaust gas of a gas turbine topping cycle to a working fluid in a bottoming Rankine cycle, including the following steps:

directing said exhaust gas in a first direction successively through superheater, vaporizer, and economizer sections of a boiler at a mass flow rate EG;

directing said working fluid in a second direction, counter to said first direction, successively through said economizer, vaporizer, and superheater sections of said boiler at a mass flow rate WF;

the ratio of said mass flow rate WF of said working fluid to said mass flow rate EG of said exhaust gas being in the range from 0.50 to >1;

the temperature differential between said exhaust gas and said working fluid being at its minimum where said working fluid enters said economizer section and said exhaust gas leaves said economizer section;

said working fluid being theoretically capable, in an ideal isentropic expansion process, of yielding a total enthalpy drop of at least 70% of the available energy of said exhaust gas as determined by second-law analysis.

10. A process as defined in claim 9, wherein said working fluid is essentially methylene chloride.

11. A process as defined in claim 10, wherein:

said exhaust gas enters said superheater section at a temperature not greater than 1250° F.;

said working fluid is in a sub-critical state through said boiler, and at a pressure not less than 650 psia in said boiler;

whereby said working fluid is effective to extract heat from exhaust gas to cool said exhaust gas from above 1000° F. to below 200° F.

* * * * *